US008285157B2

(12) United States Patent
Hayashi

(10) Patent No.: US 8,285,157 B2
(45) Date of Patent: Oct. 9, 2012

(54) DEVELOPING DEVICE AND IMAGE FORMING APPARATUS

(75) Inventor: Shigeki Hayashi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 267 days.

(21) Appl. No.: 12/615,474

(22) Filed: Nov. 10, 2009

(65) Prior Publication Data

US 2010/0119263 A1 May 13, 2010

(30) Foreign Application Priority Data

Nov. 11, 2008 (JP) ..... 2008-288419

(51) Int. Cl.
*G03G 15/08* (2006.01)

(52) U.S. Cl. ..... 399/30

(58) Field of Classification Search ..... 399/30, 399/61, 62, 63, 254, 258, 255
See application file for complete search history.

(56) References Cited

U.S. PATENT DOCUMENTS

| | | | | |
|---|---|---|---|---|
| 4,342,283 | A * | 8/1982 | Terashima | 399/63 |
| 2007/0196116 | A1* | 8/2007 | Watanabe | 399/30 |

FOREIGN PATENT DOCUMENTS

| | | | |
|---|---|---|---|
| JP | 56-74278 | A | 6/1981 |
| JP | 5-307327 | A | 11/1993 |
| JP | 10-63081 | A | 3/1998 |
| JP | 10-268623 | A | 10/1998 |
| JP | 2000-10395 | A | 1/2000 |
| JP | 2006-154235 | A | 6/2006 |
| JP | 2007-65400 | A | 3/2007 |
| JP | 2007-93777 | A | 4/2007 |
| JP | 2008-145875 | A | 6/2008 |

* cited by examiner

*Primary Examiner* — Walter L Lindsay, Jr.
*Assistant Examiner* — Frederick Wenderoth
(74) *Attorney, Agent, or Firm* — Birch, Stewart, Kolasch & Birch, LLP

(57) ABSTRACT

A developing device and an image forming apparatus are provided, which prevent the output of the sensor from being destabilized due to the loose aggregation and stagnation of a developer on the detection surface of a permeability sensor and stabilize the output of the permeability sensor so as to enable highly precise toner concentration control. The developing device includes a transport passage, a developing roller that supplies to a photosensitive drum the two-component developer passing through the transport passage, a transport member that stirs the two-component developer in the transport passage and supplies the two-component developer to the developing roller, and the permeability sensor that is disposed in the transport passage to detect a toner concentration of the two-component developer. The developing device also includes an electromagnet located adjacent to the permeability sensor. The electromagnet is supplied with an intermittent flow of current to make the developer active in movement.

14 Claims, 8 Drawing Sheets

DEVELOPING DEVICE AND IMAGE FORMING APPARATUS

CROSS-NOTING PARAGRAPH

This non-provisional application claims priority under 35 U.S.C. §119 (a) on Patent Application No. 2008-288419 filed in JAPAN on Nov. 11, 2008, the entire contents of which are hereby incorporated herein by reference.

FIELD OF THE INVENTION

The present invention relates generally to a developing device and an image forming apparatus, and, more particularly, to a developing device and an image forming apparatus employing an electrophotographic method.

BACKGROUND OF THE INVENTION

Conventionally, an image forming apparatus employing the electrophotographic method, such as a copier, printer, and facsimile, has been known. The image forming apparatus employing the electrophotographic method forms an electrostatic latent image on the surface of a photosensitive drum (toner image carrier), causes a developing device to supply toner to the photosensitive drum to develop the electrostatic latent image, transfers a toner image formed by development on the photosensitive drum to a sheet, such as a recording paper, and causes a fixing device to fix the toner image to the sheet.

The image forming apparatus has recently been adapted to demands for full color images and high quality images, and a two-component developer having superior toner electrifying stability is often used in such an image forming apparatus. This two-component developer is composed of toner and a carrier. The toner and carrier are rubbed against another when they are stirred in the developing device and properly charged toner is obtained due to the friction.

In the developing device, charged toner is supplied, for example, to the surface of a developing roller. Toner supplied to the developing roller is moved to an electrostatic latent image formed on the photosensitive drum by an electrostatic attraction force. As a result, a toner image based on the electrostatic latent image is formed on the photosensitive drum.

The image forming apparatus which is faster in processing speed and smaller in size has been demanded in recent years. This brings a need of quick and sufficient electrification of the two-component developer and faster transport of the two-component developer.

Under such circumstances, a circulatory developing device disclosed in Japanese Laid-Open Patent Publication No. 10-63081 has been adopted to cause replenished toner to disperse instantly into the two-component developer to give toner proper amount of electricity in the image forming apparatus. The circulatory developing device has a two-component developer transport passage through which the two-component developer is circulated and a two-component developer transporting member that transports the two-component developer while stirring it through the two-component developer transport passage.

The above circulatory developing device offers an advantage of miniaturizing the developing device, but also accompanies a disadvantage that a transport roller must be rotated at high speed because it takes a longer time for replenished toner to reach a development area when a large amount of toner is consumed. High-speed rotation of the transport roller, however, causes the stagnation of the developer, which is a phenomenon that the developer gathers into a loosely aggregated state in a gap between the inner wall of the developing device and the transport roller to become slow in movement.

This leads to a problem that when a permeability sensor disposed on the inner wall of the developing device detects the toner concentration of the two-component developer, a bad flow of the developer on the surface (detection surface) of the permeability sensor destabilizes output of the sensor.

SUMMARY OF THE INVENTION

An object of the present invention is to provide a developing device and an image forming apparatus that stabilize output of a permeability sensor to enable highly precise toner concentration control.

Another object of the present invention is to provide a developing device having a transport passage, a developing roller that supplies to a photosensitive drum a two-component developer passing through the transport passage, a transport member that stirs the two-component developer in the transport passage and supplies the two-component developer to the developing roller, and a permeability sensor that is disposed in the transport passage and detects a toner concentration of the two-component developer, and the developing device having an electromagnet located adjacent to the permeability sensor.

Yet another object of the present invention is to provide the developing device wherein a ferromagnetic material on which a magnetic field formed by the electromagnet converges is disposed at a position where the ferromagnetic material pairs with the electromagnet across a permeability sensor.

Still another object of the present invention is to provide the developing device wherein a counter electromagnet pairing with the electromagnet to form a magnetic field is disposed at a position where the counter electromagnet pairs with the electromagnet across a permeability sensor.

Yet still another object of the present invention is to provide the developing device wherein the transport member has a stirring plate disposed at a position close to a permeability sensor.

Still yet another object of the present invention is to provide the developing device wherein the stirring plate is set perpendicular to the axis of rotation of the transport member.

A further object of the present invention is to provide the developing device wherein the electromagnet is driven with an alternating current.

A yet further object of the present invention is to provide the developing device wherein a frequency of the alternating current is 1 Hz or higher and 20 Hz or lower.

A still further object of the present invention is to provide the developing device comprising: another transport passage for transporting the two-component developer, that is disposed side by side with the transport passage; and communicative connection paths through which the transport passage and the another transport passage are communicatively connected to each other at both ends of both transport passages in a direction of transport of the two-component developer; and wherein the transport passage and the another transport passage transport the developer in directions reverse to each other.

A yet still further object of the present invention is to provide an image forming apparatus comprising the developing device as defined hereinabove.

PREFERRED EMBODIMENT OF THE INVENTION

The best modes for carrying out the present invention will now be described with reference to the accompanying drawings.

Figure 1:
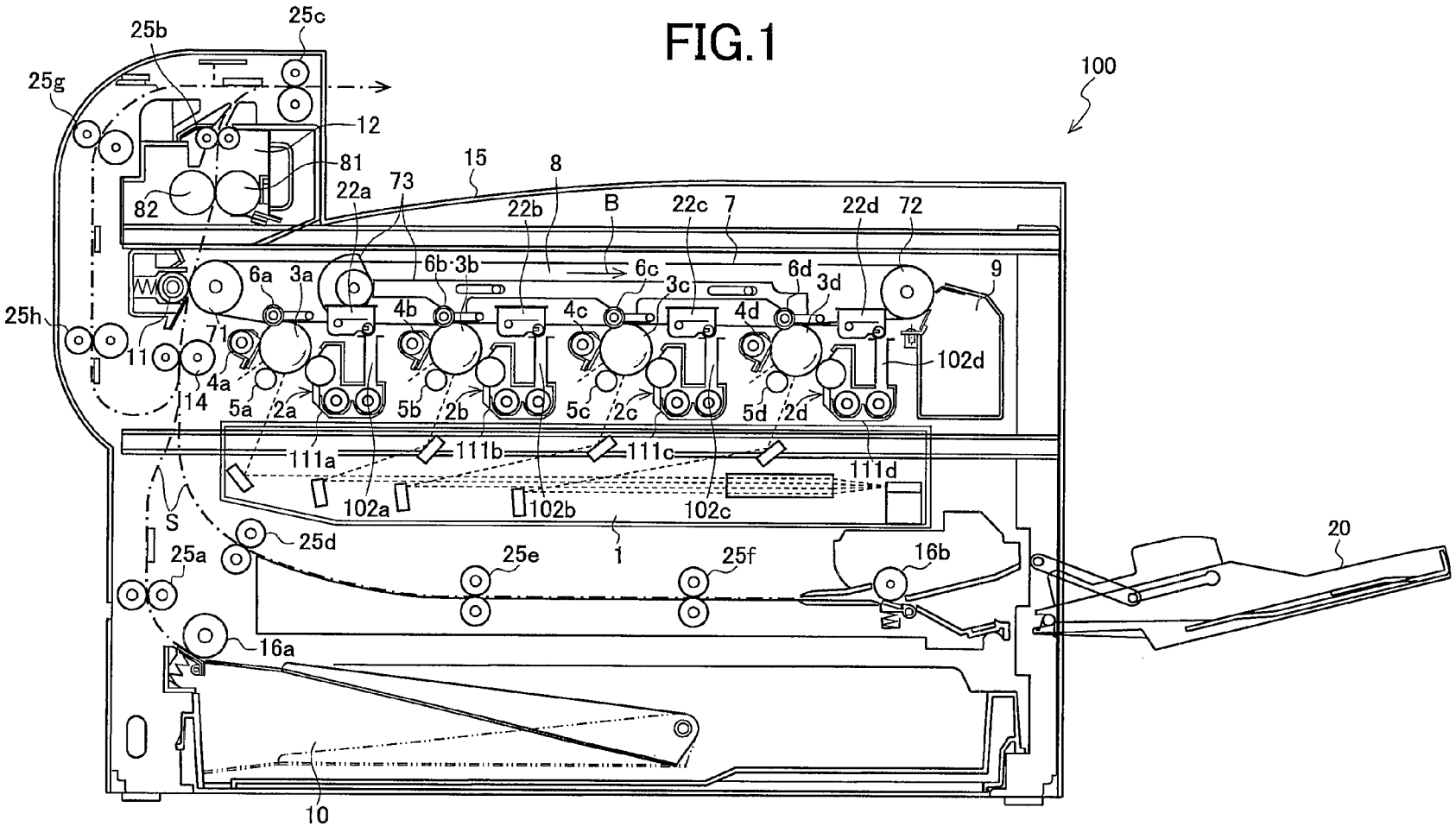
FIG. 1 is an explanatory diagram of an overall configuration of an image forming apparatus having a developing device of one embodiment of the present invention.

FIG. 1 is an explanatory diagram of an overall configuration of an image forming apparatus having a developing device of one embodiment of the present invention.

As shown in FIG. 1, the image forming apparatus 100 includes photosensitive drums 3 (3*a* to 3*d*) on the surfaces of which an electrostatic latent image is formed, electrifiers (5*a* to 5*d*) each of which electrifies the surface of the photosensitive drum 3, an exposure unit 1 that forms the electrostatic latent image on the surface of the photosensitive drum 3, developing devices 2 (2*a* to 2*d*) each of which supplies toner to the electrostatic latent image on the surface of the photosensitive drum 3 to form a toner image, toner replenishing devices 22 (22*a* to 22*d*) each of which replenishes the developing device 2 with toner, an intermediate transfer belt unit 8 that transfers the toner image on the surface of the photosensitive drum 3 to a recording medium, and a fixing unit 12 that fixes the toner image on the recording medium.

The image forming apparatus 100 electrophotographically forms a single-color or multicolor image on a given sheet (recording paper, recording medium), using toner, in accordance with image data transmitted to the apparatus from the outside. The image forming apparatus 100 may have a scanner and the like, above the apparatus.

As shown in FIG. 1, the image forming apparatus 100 processes image data for each color element of black (K), cyan (c), magenta (M), and yellow (Y) to form a black image, a cyan image, a magenta image, and a yellow image, and superposes such images of respective color elements to form a color image.

The image forming apparatus 100, therefore, includes four developing devices 2 (2*a* to 2*d*), four photosensitive drums 3 (3*a* to 3*d*), four electrifiers 5 (5*a* to 5*d*), and four cleaner units (4*a* to 4*d*), as shown in FIG. 1, so as to form images of respective color elements. In other words, four image forming stations (image forming portions) each having one developing device 2, one photosensitive drum 3, one cleaner unit 4, and one electrifier 5 are provided.

Among reference numerals a to d, a denotes a member for forming a black image, b denotes a member for forming a cyan image, c denotes a member for forming a magenta image, and d denotes a member for forming a yellow image. The image forming apparatus 100 also includes the exposure unit 1, the fixing unit 12, a sheet transport passage S, a paper feeding tray 10, and a paper ejecting tray 15.

The electrifier 5 uniformly electrifies the surface of the photosensitive drum 3 at a given voltage.

A contact brush type electrifier or a noncontact charger type electrifier as well as a contact roller type electrifier shown in FIG. 1 may be sometimes used as the electrifier 5.

The exposure unit 1 is a laser scanning unit (LSU) having a laser-emitting portion and reflecting mirrors, as shown in FIG. 1. Besides the laser scanning unit, an EL (electroluminescence) composed of an array of light-emitting elements or an LED writing head may be used as the exposure unit 1. The exposure unit 1 exposes the electrified photosensitive drum 3 in accordance with input image data to form an electrostatic latent image corresponding to the image data on the surface of the photosensitive drum 3.

The developing device 2 (2*a* to 2*d*) visualizes (develops) the electrostatic latent image formed on the photosensitive drum 3 using any toner of K, C, M, or Y. Above the developing device 2, toner transport mechanisms 102 (102*a* to 102*d*) and toner replenishing devices 22 (22*a* to 22*d*) are disposed. The developing device 2 has developing vessels 111 (111*a* to 111*d*).

The cleaner unit 4 removes and collects the toner remaining on the surface of the photosensitive drum 3 after development and image transfer processes.

The intermediate transfer belt unit 8 is disposed above the photosensitive drum 3. The intermediate transfer belt unit 8 has intermediate transfer rollers 6 (6*a* to 6*d*), an intermediate transfer belt 7, an intermediate transfer belt driving roller 71, an intermediate transfer belt driven roller 72, an intermediate transfer belt tension mechanism 73, and an intermediate transfer belt cleaning unit 9.

The intermediate transfer rollers 6 (6*a* to 6*d*), the intermediate transfer belt driving roller 71, the intermediate transfer belt driven roller 72, and the intermediate transfer belt tension mechanism 73 drive the intermediate-transfer belt 7 laid around the rollers and mechanism in a tensioned state to rotate in an arrowed direction B of FIG. 1.

The intermediate transfer rollers 6 are supported rotatably on an intermediate transfer roller mounting portion of the intermediate transfer belt tension mechanism 73 of the intermediate transfer belt unit 8.

The intermediate transfer belt 7 is disposed to be in direct contact with each photosensitive drum 3. Toner images of respective color elements formed on the photosensitive drums are transferred and superposed sequentially onto the intermediate transfer belt 7 to form a color toner image (multicolor toner image). The intermediate transfer belt 7 is made of a film that is, for example, 100 μm to 150 μm in thickness and formed into an endless shape.

Transfer of a toner image from the photosensitive drum 3 to the intermediate transfer belt 7 is carried out by the intermediate transfer roller 6 that is in contact with the back of the intermediate transfer belt 7. To the intermediate transfer roller 6, a high-voltage bias (having a polarity (+) opposite to the polarity (−) of charged toner) is applied to transfer the toner image to the intermediate transfer belt 7.

The intermediate transfer roller 6 is made using a metal (e.g., stainless) shaft having a diameter of, for example, 8 mm to 10 mm as its basis and its surface is covered with a conductive elastic material (e.g., EPDM, urethane foam, etc.). This conductive elastic material enables the intermediate transfer roller 6 to uniformly apply a high-voltage to the intermediate transfer belt 7. In the present embodiment, a roller-shaped transfer electrode (intermediate transfer roller 6) is used, but a brush type transfer electrode may also be used.

As described above, electrostatic latent images on the photosensitive drums 3 are developed with toner of respective color elements into visual toner images, which are then superposed and overlaid onto the intermediate transfer belt 7. The overlaid toner image is moved by the rotation of the intermediate transfer belt 7 to a position of contact (transfer portion) between a transported paper and the intermediate transfer belt 7, and is transferred to the paper by the transfer roller 11 disposed at this position. In this case, the intermediate transfer belt 7 and the transfer roller 11 are in pressure contact with each other with a given nip and a voltage for transferring the toner image to the paper is applied to the transfer roller 11. This voltage is a high voltage having a polarity (+) opposite to the polarity (−) of the charged toner.

To constantly provide the above nip, either one of the transfer roller 11 or the intermediate transfer belt driving roller 71 is made of a hard material, such as a metal, while the other is made of a soft material such as an elastic roller (for example, an elastic rubber roller or an expandable resin roller).

Toner adhering to the intermediate transfer belt 7 due to a contact between the intermediate transfer belt 7 and the photosensitive drum 3 and toner not being transferred to the paper but remaining on the intermediate transfer belt 7 when the toner image is transferred from the intermediate transfer belt 7 to the paper become the cause of color mixing by the toner at the next process. Such toner is, therefore, removed and collected by the intermediate transfer belt cleaning unit 9.

The intermediate transfer belt cleaning unit 9 has a cleaning blade (cleaning member) that is in contact with the intermediate transfer belt 7. The portion of intermediate transfer belt 7 that is in contact with the cleaning blade is supported by the intermediate transfer belt driven roller 72 on the back of the portion.

The paper feeding tray 10 stores sheets (e.g., recording papers) used for image formation and is disposed below the image forming portion and the exposure unit 1. The paper ejecting tray 15 disposed on the upper part of the image forming apparatus 100 is a tray on which the printed sheets placed facedown.

The image forming apparatus 100 includes the sheet transport passage S through which a sheet from the paper feeding tray 10 or from a manual insertion tray 20 is guided to the paper ejecting tray 15 via the transfer portion and the fixing unit 12. The transfer portion is situated between the intermediate transfer belt driving roller 71 and the transfer roller 11.

The sheet transport passage S is provided with pickup rollers 16 (16*a* and 16*b*), a resist roller 14, the transfer portion, the fixing unit 12, transport rollers 25 (25*a* and 25*h*), and the like.

A transport roller 25 is a small-sized roller that facilitates and assists a transport of a sheet and a plurality of transport rollers 25 are arranged along the transport passage S. The pickup roller 16*a* is a take-in roller to supply sheets one by one from the paper feeding tray 10 into the sheet transport passage S and is disposed on an end of the paper feeding tray 10. The pickup roller 16*b* is a take-in roller to supply sheets one by one from the manual insertion tray 20 into the sheet transport passage S and is disposed near the manual insertion tray 20. The resist roller 14 temporarily holds a sheet transported on the sheet transport passage S, and transports the sheet to the transfer portion so that the leading edge of a toner image on the intermediate transfer belt 7 meets timely the leading edge of the sheet.

The fixing unit 12 has a heating roller 81, a pressure roller 82, and the like and the heating roller 81 and the pressure roller 82 rotate while holding a sheet between them. The heating roller 81 is controlled by a control portion (not shown) to have a given fixing temperature. The control portion controls the temperature of the heating roller 81 based on a detection signal from a temperature detector (not shown).

The heating roller 81 cooperates with the pressure roller 82 to thermo compress the sheet and melts, mixes, and pressurizes each of toner images of respective colors transferred to the sheet to thermally fix the toner images on the sheet. The sheet carrying the multicolor toner image (toner images of respective colors) fixed thereon is transported by a plurality of transport rollers 25 to a turn-over paper ejecting passage of the sheet transport passage S, and ejected onto the paper ejecting tray 15 in a state of being turned over (the multicolor toner image faces downward).

Sheet transport operation through the sheet transport passage S will then be described.

As shown in FIG. 1, the image forming apparatus 100 includes the paper feeding tray 10 that stores sheets in advance and the manual insertion tray 20 that is used in a case of printing a few sheets, or so. Both trays are provided with the pickup rollers 16 (16*a* and 16*b*), respectively, which supply sheets one by one to the sheet transport passage S.

In a case of single-face printing, a sheet sent out from the paper feeding tray 10 is transported by the transport roller 25*a* in the sheet transport passage S to the resist roller 14, which then transports the sheet to the transfer portion (position of contact between the transfer roller 11 and the intermediate transfer belt 7) so that the leading edge of the sheet meets timely the leading edge of a toner image overlaid on the intermediate transfer belt 7. At the transfer portion, the toner image is transferred to the sheet, and the transferred toner image is fixed on the sheet at the fixing unit 12. Subsequently, the sheet is ejected onto the paper ejecting tray 15 from the paper ejecting roller 25*c* via the transport roller 25*b*.

A sheet sent out from the manual insertion tray 20 is transported by a plurality of transfer rollers 25 (25*f*, 25*e*, and 25*d*) to the resist roller 14. After that, the sheet is transported through the same passage as the sheet supplied from the paper feeding tray 10 is transported and ejected onto the paper ejecting tray 15.

In a case of double-face printing, a sheet having finished with single-face printing and passed through the fixing unit 12, as described above, is chucked on the trailing edge of the sheet by the paper ejecting roller 25*c*. The sheet is then guided to the transport rollers 25*g* and 25*h* due to the reverse rotation of the paper ejecting roller 25*c* and is ejected onto the paper ejecting tray 15 after being subjected to back face printing via the resist roller 14 again.

The developing device will then be described referring to the drawings.

Figure 2:
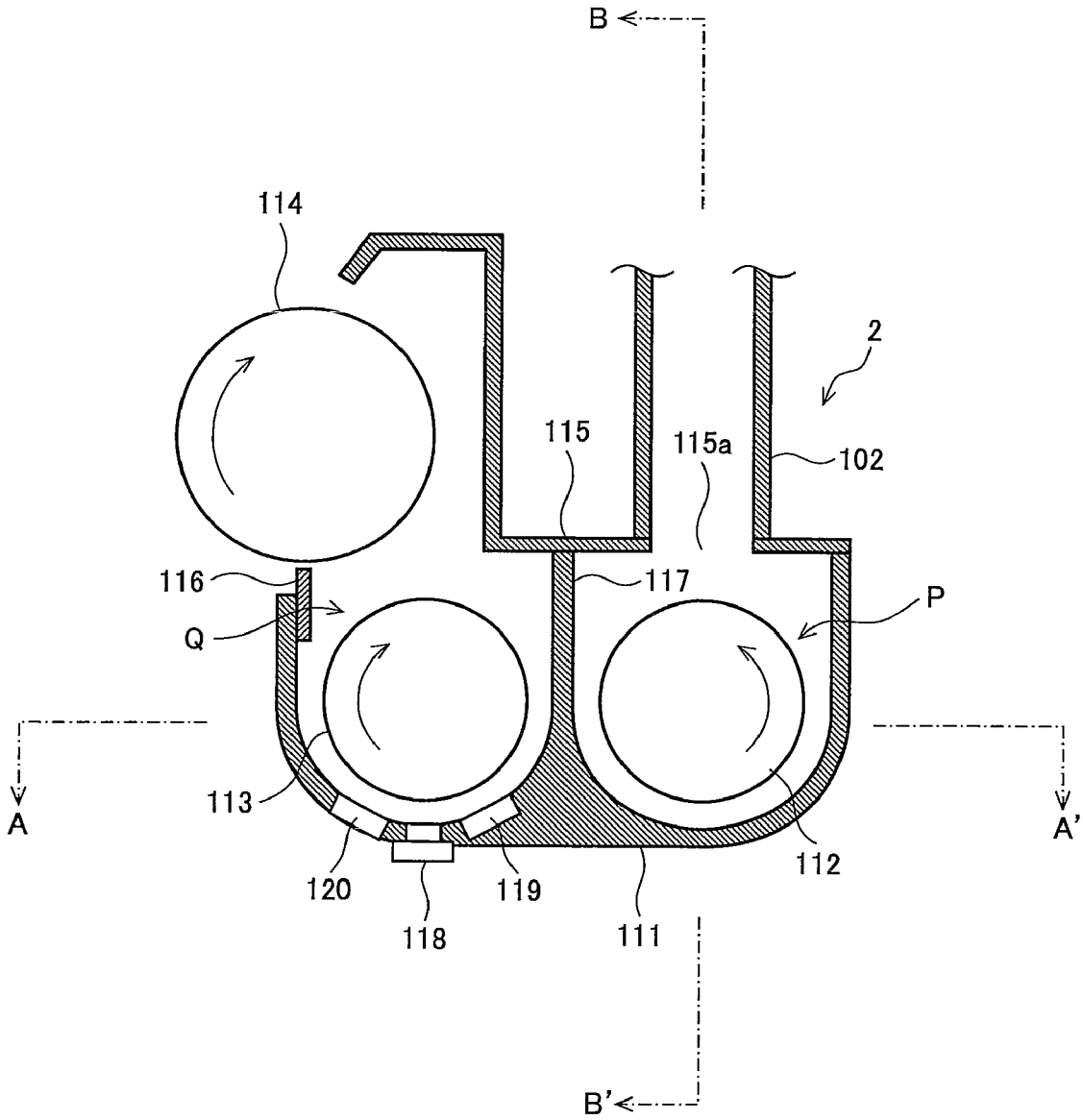
FIG. 2 is a sectional view of a configuration of the developing device of one embodiment of the present invention.
Figure 3:
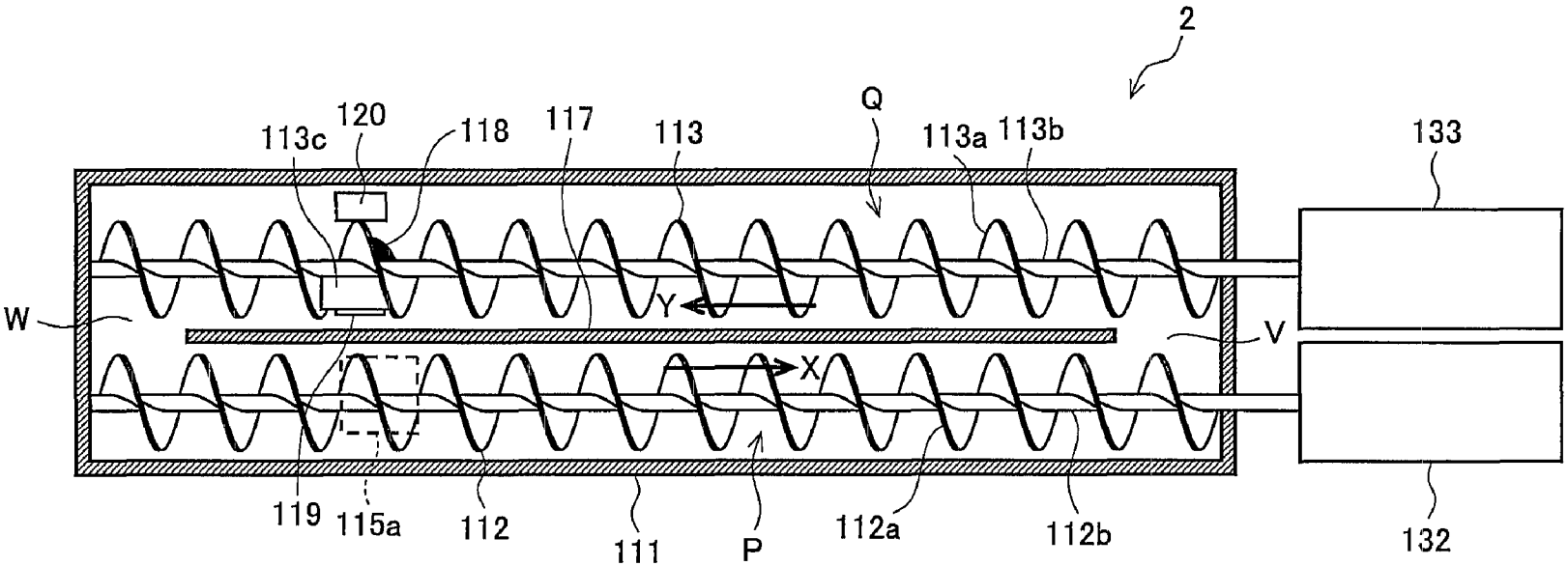
FIG. 3 is a sectional view along an A-A' line of FIG. 2.
Figure 4:
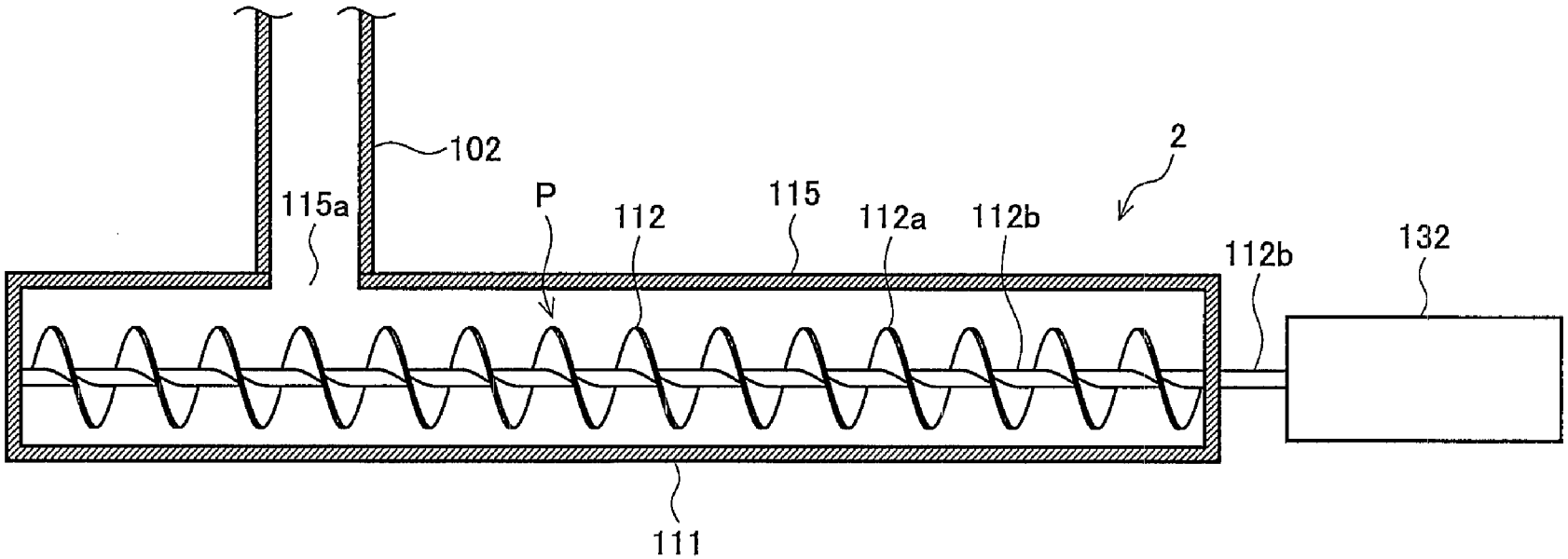
FIG. 4 is a sectional view along a B-B' line of FIG. 2.

FIG. 2 is a sectional view of a configuration of the developing device of one embodiment of the present invention, FIG. 3 is a sectional view along an A-A' line of FIG. 2, and FIG. 4 is a sectional view along a B-B' line of FIG. 2.

As shown in FIG. 2, the developing device 2 has a developing roller 114 that is located so as to face the photosensitive drum 3 in the developing vessel 111. The developing device 2 is the device that causes the developing roller 114 to supply toner to the surface of the photosensitive drum 3 to develop (visualize) an electrostatic latent image formed on the surface of the photosensitive drum 3.

The developing device 2 also has the developing vessel 111, a developing vessel cover 115, a toner supply port 115*a*, a doctor blade 116, a first transport member 112, a second transport member 113, a partition panel (partition wall) 117, a permeability sensor 118, an electromagnet 119, and a counter electromagnet 120 in addition to the developing roller 14.

The electromagnet 119 and the counter electromagnet 120 are supplied with electric current from a power supply (not shown) to form a magnetic field directed from the electromagnet 119 toward the counter electromagnet 120 (or a magnetic field having a direction opposite to that of the above magnetic field). The action of the electromagnets will be described later.

The developing vessel 111 is a vessel holding a two-component developer containing toner and a carrier. The developing vessel 111 houses therein the developing roller 114, the first transport member 112, the second transport member 113, and the like. The carrier of the present embodiment is the magnetic carrier possessing magnetism.

The developing roller 114 is a magnet roller that is driven to rotate around its axis by a driving means (not shown) and transports the two-component developer in the developing vessel 111 to the photosensitive drum 3. The developing roller 114 faces the photosensitive drum 3 and is disposed to separate from the photosensitive drum 3 with a gap. The two-component developer transported by the developing roller 114 gets in contact with the photosensitive drum 3 at the portion where the developing roller 114 comes nearest to the photosensitive drum 3. This contact area is a development nip portion, where a power supply (not shown) connected to the developing roller 114 applies a development bias voltage to the developing roller 114. As a result, toner is supplied from the two-component developer on the surface of the developing roller 114 to the electrostatic latent image on the surface of the photosensitive drum 3.

The doctor blade 116 is the platelike member that extends in parallel with the axis of the developing roller 114. The doctor blade 116 is disposed right under the developing roller 114 in such a way that one of its width direction ends is supported by the developing vessel 111 while the other end is separated from the surface of the developing roller 114 with a gap. The doctor blade 116 is made of stainless steel, and may also be made of aluminum, synthetic resin, and the like.

The permeability sensor 118 is attached to the base of the developing vessel 111 right under the second transport member 113 so that the sensor surface is exposed to the interior of the developing vessel 111. The permeability sensor 118 is connected electrically to a toner concentration control means (not shown). An ordinary permeability sensor can be used for the permeability sensor 118, for example, a transmitted light detecting sensor, reflected light detecting sensor, and magnetism-permeability detecting sensor are available, and among which the magnetism-permeability detecting sensor is most preferable. The function of the toner concentration control means will be described later.

The magnetism-permeability detecting sensor is connected to a power supply (not shown). The power supply applies a driving voltage for driving the magnetism-permeability detecting sensor and a control voltage for outputting a toner concentration detection result to the control means, to the magnetism-permeability detecting sensor. Voltage application by the power supply to the magnetism-permeability detecting sensor is controlled by the control means. The magnetism-permeability detecting sensor is a sensor that outputs a toner concentration detection result as an output voltage value when a control voltage is applied. Because the magnetism-permeability detecting sensor in general is highly sensitive to a voltage near the median of an output voltage, a control voltage for acquiring an output voltage near the median is applied to the magnetism-permeability detecting sensor in its usage. The magnetism-permeability detecting sensor of this type is on the market as commercial products, such as TS-L, TS-A, and TS-K (which are the names of products released by TDK Corporation).

As shown in FIGS. 2 and 4, the removable developing vessel cover 115 is disposed on the developing vessel 111. As shown in FIG. 4, the toner supply port 115*a* for supplying unused toner to the developing vessel 111 is formed on the developing vessel 111. As shown in FIG. 1, toner stored in the toner replenishing device 22 is transported through the toner transport mechanism 102 and the toner supply port 115*a* to the developing vessel 111 to supply the developing vessel 111 with toner.

The first transport member 112 is composed of a screw auger having a helical first transport vane 112*a* and a first rotating shaft 112*b*, and the second transport member 113 is composed of a screw auger having a helical second transport vane 113*a* and a second rotating shaft 113*b*. The first transport vane 112*a* and the second transport vane 113*a* rotate respectively to stir and transport the two-component developer.

In the developing vessel 111, the partition panel 117 is disposed between the first transport member 112 and the second transport member 113. The partition panel 117 extends in parallel with the rotating shafts of the first transport member 112 and the second transport member 113. The partition panel 117 divides the interior of the developing vessel 111 into a first transport passage P in which the first transport member 112 is placed and a second transport passage Q in which the second transport member 113 is placed. In this manner, the first transport passage P and the second transport passage Q are arranged side by side.

The partition panel 117 is disposed to be separated from the inner wall surface of the developing vessel 111 at both ends in each axial direction of the first transport member 112 and the second transport member 113. As a result, in the developing vessel 111, communicative connection paths that communicatively connect the first transport passage P to the second transport passage Q are formed near the both ends in each axial direction of the first transport member 112 and the second transport member 113. Hereinafter, as shown in FIG. 3, the communicative connection path formed on the downstream side in the direction of the arrow X will be referred to as a first communicative connection path V, and the communicative connection path formed on the downstream side in the direction of the arrow Y will be referred to as a second communicative connection path W.

The first transport member 112 and the second transport member 113 are arranged parallel with each other so that the peripheral faces of both transport members face each other across the partition panel 117 and the shafts of both transport members are parallel with each other. Each of the transport members is set to rotate in opposite direction. The first transport member 112 is set to transport the two-component developer in the direction of the arrow X, while the second transport member 113 is set to transport the two-component developer in the direction of the arrow Y that is opposite to the direction of the arrow X, as shown in FIG. 3.

The toner supply port 115*a* is formed in an area within the first transport passage P and at a location that is closer to the downstream side than to the second communicative connection path W in the direction of the arrow X. In other words, toner is supplied to the downstream side of the second communicative connection path W in the first transport passage P.

In the developing vessel 111, the first transport member 112 and the second transport member 113 are driven to rotate by a first transport member driving motor 132 and a second transport member driving motor 133, respectively, to transport the two-component developer.

Specifically, in the first transport passage P, the two-component developer is transported in the direction of the arrow X while being stirred by the first transport member 112, to reach the first communicative connection path V. After reaching the first communicative connection path V, the two-component developer is transported to the second transport passage Q through the first communicative connection path V.

In the second transport passage Q, the two-component developer is transported in the direction of the arrow Y while being stirred by the second transport member 113, to reach the second communicative connection path W. After reaching the second communicative connection path W, the two-component developer is transported to the first transport passage P through the second communicative connection path W.

That is, each of the first transport member 112 and the second transport member 113 transport the two-component developer, in the opposite direction while stirring the developer.

In this manner, the two-component developer circulates the first transport passage P, the first communicative connection path V, the second transport passage Q, and the second communicative connection path Win this order. The two-component developer is scooped up onto the surface of the developing roller 114 through the rotation of the developing roller 114 while being transported through the second transport passage Q. Toner in the scooped two-component developer is then moved to the photosensitive drum 3, and is consumed sequentially.

To replenish toner that is consumed in the above manner, unused toner is supplied through the toner supply port 115*a* into the first transport passage P, where the supplied toner is mixed and stirred with the two-component developer already present in the transport passage P.

The second transport member 113 located near the permeability sensor 118 disposed in the second transport passage Q is provided with a stirring plate 113*c* that is perpendicular to the second rotating shaft 113*b*. This stirring plate 113*c* increases a slide-friction force on the detection surface of the permeability sensor 118, thus making the two-component developer active in movement to prevent the developer from stagnating.

Figure 5:
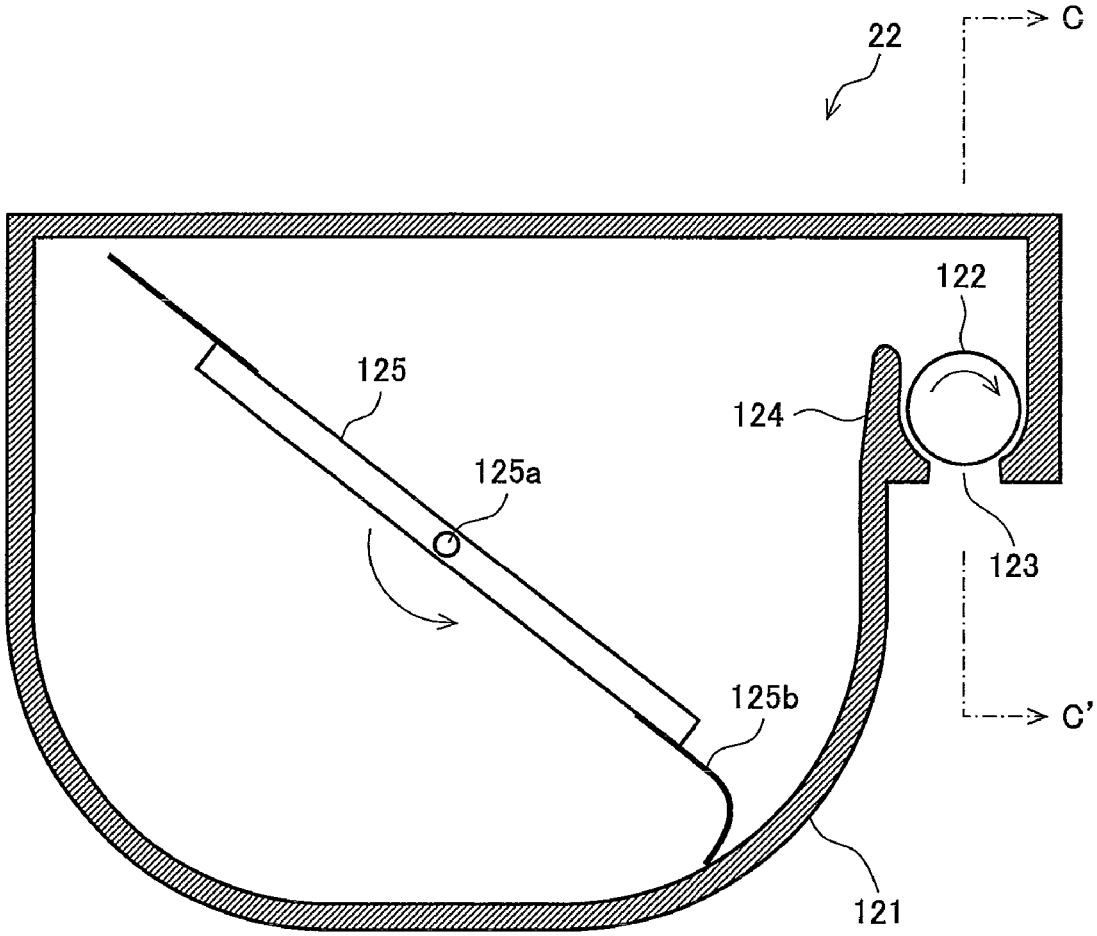
FIG. 5 is a sectional view of a configuration of a toner replenishing device 22 of FIG. 1.
Figure 6:
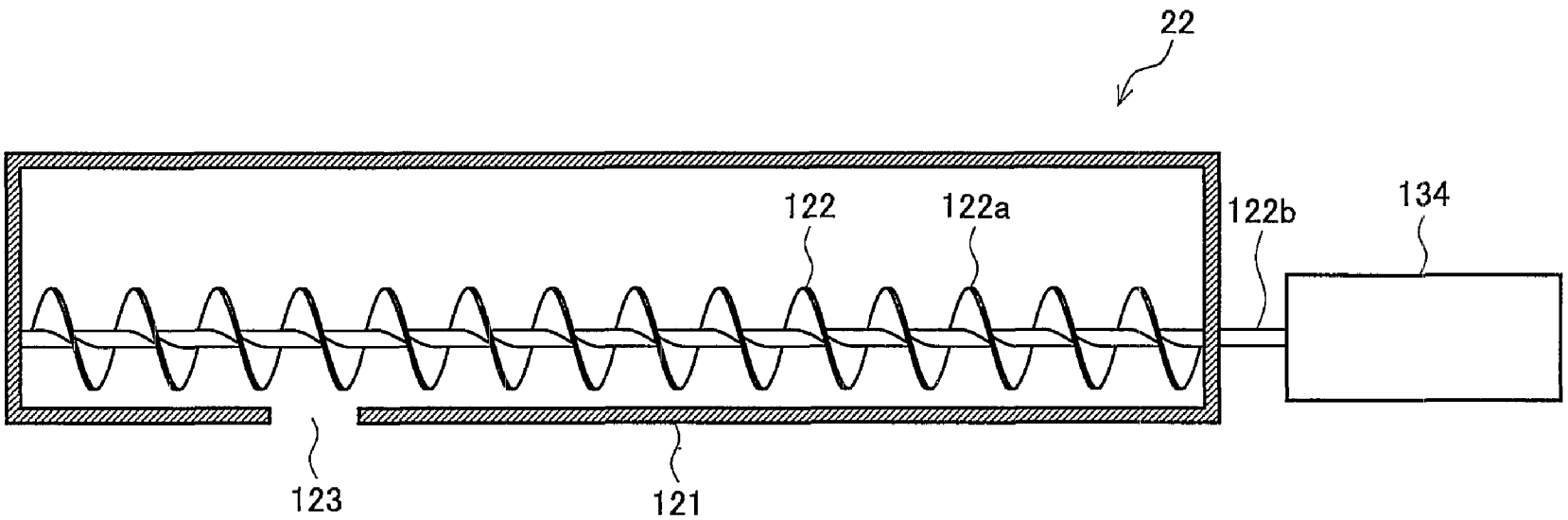
FIG. 6 is a sectional view along a C-C' line of FIG. 5, depicting an enlarged view of the perimeter of a toner discharging member of FIG. 5.

FIG. 5 is a sectional view of a configuration of the toner replenishing device 22 of FIG. 1, and FIG. 6 is a sectional view along a C-C' line of FIG. 5, depicting an enlarged view of the perimeter of the toner discharging member of FIG. 5.

In FIG. 5, the toner replenishing device 22 includes a toner storage container 121, a toner stirring member 125, the toner discharge member 122, and a toner discharge port 123.

The toner replenishing device 22 is disposed above the developing vessel 111, and stores unused toner (powdered toner). Toner in the toner replenishing device 22 is supplied from the toner discharge port 123 to the developing vessel 111 through the toner transport mechanism 102 by the rotation of the toner discharge member (discharge screw) 122.

The toner storage container 121 is a semi-cylindrical container having an inner space, supports the toner stirring member 125 and the toner discharge member 122 to allow them rotate freely and stores toner. The toner discharge port 123 is an approximately oblong opening that is formed under the toner discharge member 122 and closer to the center of the toner discharge member 122 in the direction of its axis. The toner discharge port 123 is situated at a position where the toner discharge port 123 faces the toner transport mechanism 102.

The toner stirring member 125 is a platelike member that rotates around a rotating shaft 125*a* to stir and scoop up toner stored in the toner storage container 121 and transport toner to the toner discharge member 122. The toner stirring member 125 has toner scooping members 125*b* attached to the leading edges of the toner stirring member 125. The scooping member 125*b* is made of a flexible polyethylene terephthalate (PET) sheet, and is attached to both ends of the toner stirring member 125.

The toner discharge member 122 supplies toner in the toner storage container 121 to the developing vessel 111 through the toner discharge port 123. As shown in FIG. 6, the toner discharge member 122 is composed of a screw auger having a toner discharge member rotating shaft 122*b* and a toner transport vane 122*a*. The toner discharge member 122 is driven to rotate by a toner discharge member driving motor 134. The direction of the screw auger is set so that toner is transported from both ends in the direction of the axis of the toner discharge member 122 toward the toner discharge port 123.

A toner discharge member bulkhead 124 is disposed between the toner discharge member 122 and the toner stirring member 125. This toner discharge member bulkhead 124 allows a proper amount of toner scooped by the toner stirring member 125 to stay around the toner discharge member 122.

In FIG. 5, the toner stirring member 125 rotates in the direction of the arrow to stir toner and scoop up toner toward the toner discharge member 122. At this time, the toner scooping members 125*b* rotates while sliding the inner wall of the toner storage container 121 with the change of the shape due to its flexibility to supply toner to the toner discharge member 122. The toner discharge member 122 then leads the supplied toner to the toner discharge port 123 through the rotation of the toner discharge member 122.

The above toner concentration control means drives to rotate the toner discharge member 122 in accordance with a toner concentration measurement detected by the permeability sensor 118 and controls to supply toner into the developing vessel 111 through the toner discharge port 123.

When it is determined that a toner concentration measurement detected by the permeability sensor 118 is lower than a toner concentration preset value, the toner concentration control means sends a control signal to a driving means that drives and rotates the toner discharge member 122 to drive and rotate the toner discharge member 122 in conformity with the signal.

Figure 7:
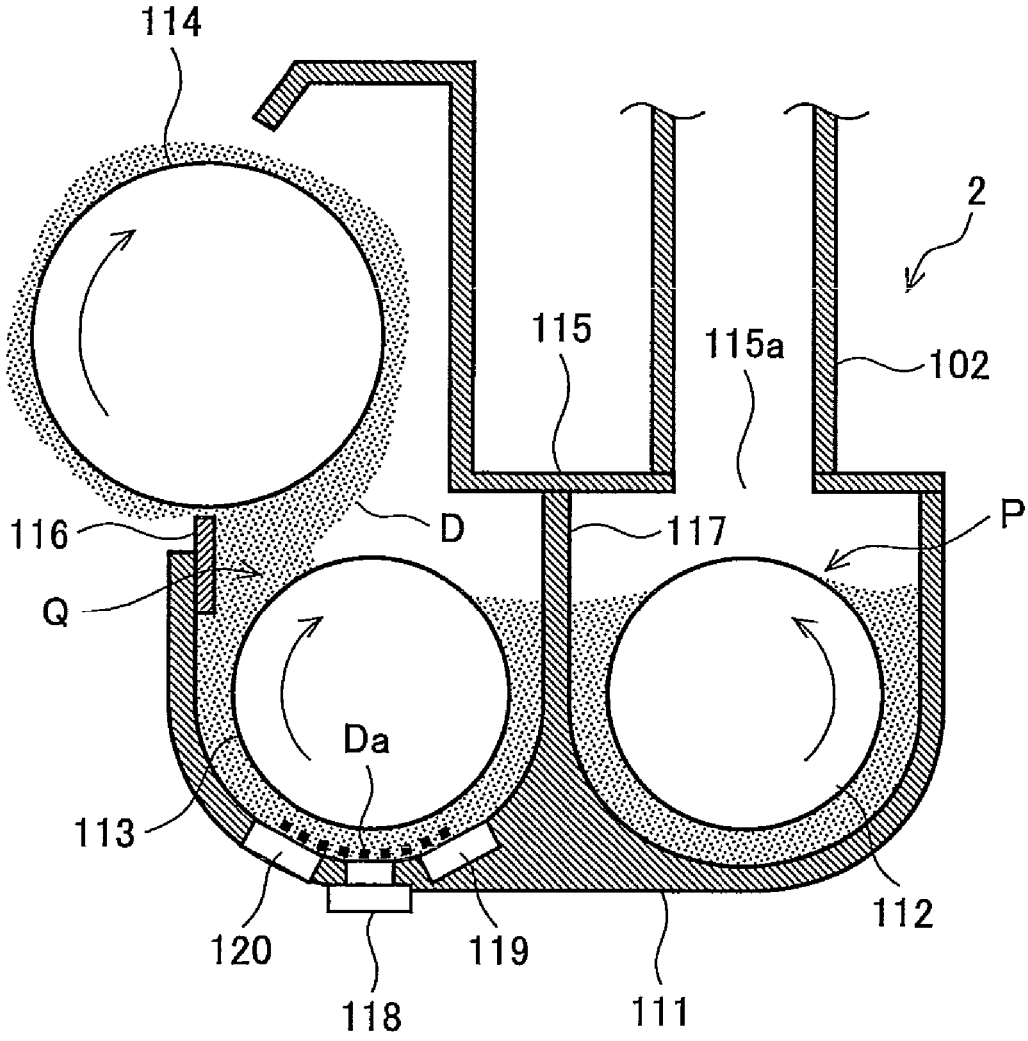
FIG. 7 is a diagrammatical explanatory view of a state of a developer in a developing vessel of the developing device of one embodiment of the present invention that results when an electromagnet is not energized.
Figure 8:
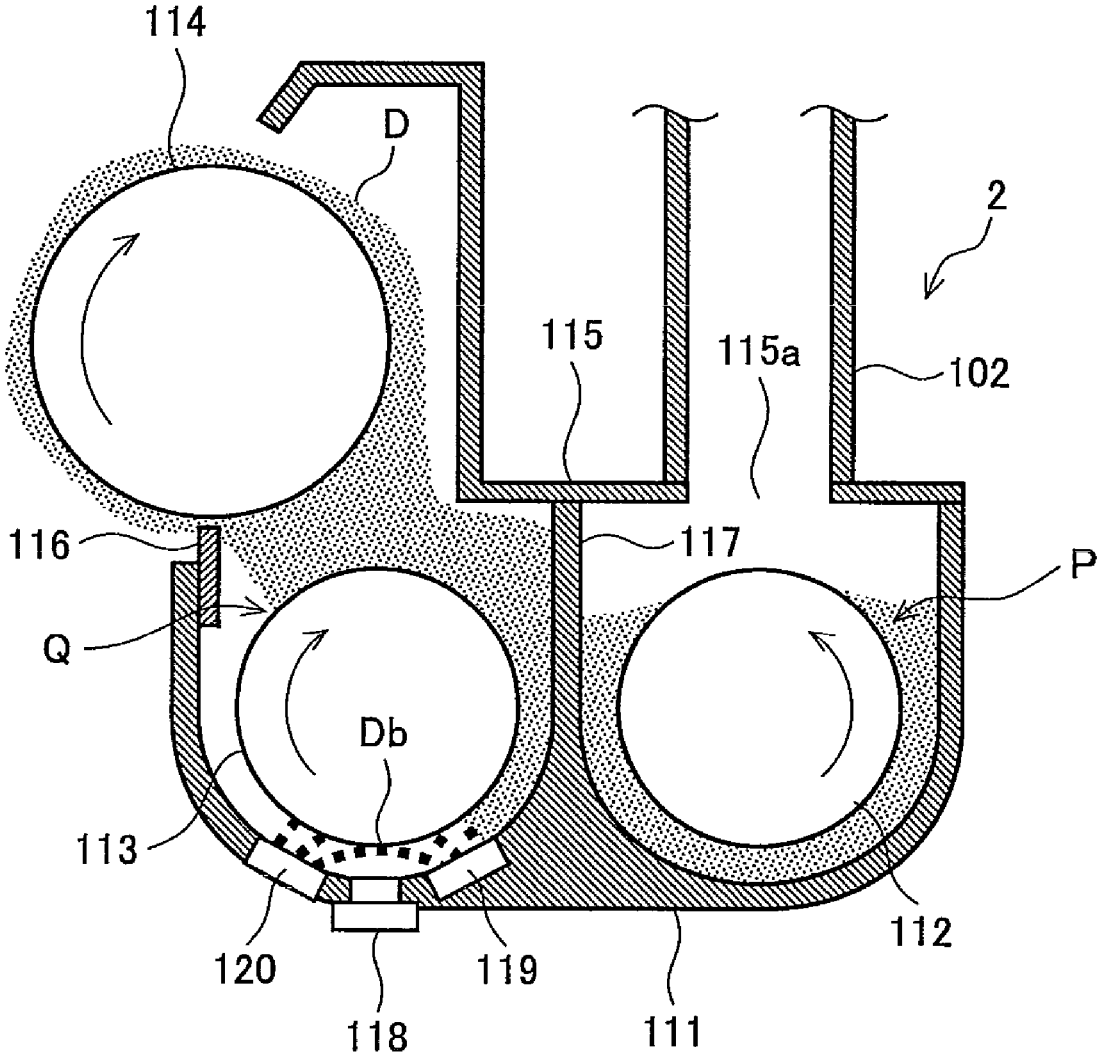
FIG. 8 is a diagrammatical explanatory view of a state of the developer in the developing vessel of the developing device of one embodiment of the present invention that results when the electromagnet is energized.

FIGS. 7 and 8 are diagrammatical explanatory views of states of the developer in the developing vessel of the developing device of one embodiment of the present invention.

FIG. 7 depicts the state where no current flows through the electromagnet 119 and the counter electromagnet 120 (when ordinary image formation is carried out), and FIG. 8 depicts the state where the current flows through the electromagnet 119 and the counter electromagnet 120 to form a magnetic field directed from the electromagnet 119 toward the counter electromagnet 120 (when image formation is not carried out).

As shown in FIG. 7, when ordinary image formation is carried out and no current is supplied to the electromagnet 119 and the counter electromagnet 120, a gap is formed between the developing vessel 111 and the second transport member 113 in the second transport passage Q. The movement of the developer Da in the gap becomes slow, thus tends to loosely aggregate in the gap. This causes a bad flow of the developer on the surface (detection surface) of the permeability sensor 118 and destabilization of output from the sensor.

When a current is supplied to the electromagnet 119 and the counter electromagnet 120, a magnetic field directed from the electromagnet 119 toward the counter electromagnet 120 is formed, and this magnetic field forces the developer Da in a loosely aggregated state (FIG. 7) to move to form a developer bridge Db along the magnetic field, as shown in FIG. 8. Since the developer bridge Db has extremely low fluidity, the developer transported by the second stirring member 113 is blocked by the developer bridge Db. As a result, the developer that can go nowhere accumulates on the second stirring member 113.

In this state, when current supply to the electromagnet 119 and the counter electromagnet 120 is cut off, the developer accumulated on the second stirring member 113 starts flowing all at once toward the detection surface of the permeability sensor 118. This increases a slide-friction force of the developer to release the developer Da from its loosely aggregated state. As a result, output of the permeability sensor 118 is stabilized, so as to enable highly precise detection of a toner concentration.

The current flowing through the electromagnet 119 should preferably be an alternating current. Since driving the electromagnet with an alternating current causes magnetic flux density to change from time to time, the developer becomes more active in movement, in comparison with a case of the use of a direct current, to be able to improve a cleaning effect on the sensor surface. The frequency of the alternating current should preferably be 1 Hz or higher and 20 Hz or lower. This is because that a frequency exceeding 20 Hz deteriorates the property of following of the developer, and it becomes difficult to obtain the above effect achieved by a flow of the alternating current, and, conversely, an excessively low frequency fails to make the developer active in movement.

The electromagnet 119 and the counter electromagnet 120 can be driven at any given moment. When the stirring plate 113*c* is provided, however, the developer bridge Db created by the electromagnet 119 and the counter electromagnet 120 temporarily collapses. For this reason, the current supplied to the electromagnet 119 and the counter electromagnet 120 is cut off when the stirring plate 113*c* reaches a position far distant from the bridge Db.

A ferromagnetic material that absorbs magnetic flux from the electromagnet 119 may be provided in place of the counter electromagnet 120.

A configuration including the electromagnet 119 only may be adopted, in which the counter electromagnet 120 and the ferromagnetic material are not used. In this case, as a result of a current flowing through the electromagnet 119, the developer Da near the permeability sensor 118 is moved along a magnetic field created by the electromagnet 119, and the moved developer Da blocks the developer transported by the second stirring member 113. Hence the developer that can go nowhere accumulates on the second stirring member 113.

According to the present invention, the two-component developer stagnated (loosely aggregated) on the detection surface of the permeability sensor that is out of reach of the transport member can be forcibly moved by a magnetic force. As a result, even when the two-component developer loosely aggregates near the detection surface of the permeability sensor to destabilize a flow of the developer on the detection surface of the permeability sensor, the two-component developer is released from its loosely aggregated state. This stabilizes output of the sensor so as to enable highly precise detection of a toner concentration.

According to the present invention, magnetic flux generated from the electromagnet converges onto the ferromagnetic material, or the electromagnet and the counter electromagnet form a strong magnetic field. This enhances magnetic flux density on the surface of the permeability sensor.

According to the present invention, the stirring plate increases a slide-friction force on the detection surface of the permeability sensor to make the developer more active in movement. This offers an effect of suppressing the stagnation of the developer.

According to the present invention, a toner concentration can be controlled stably to form an image that is stable, higher in thickness, and no fogging.

The invention claimed is:

1. A developing device, comprising:

a transport passage, a developing roller that supplies to a photosensitive drum a two-component developer passing through the transport passage, a transport member that stirs the two-component developer in the transport passage and supplies the two-component developer to the developing roller, a permeability sensor that is disposed in the transport passage and detects a toner concentration of the two-component developer, and an electromagnet located adjacent to the permeability sensor, wherein the electromagnet is driven with an alternating current.

2. The developing device as defined in claim 1, wherein a ferromagnetic material on which a magnetic field formed by the electromagnet converges is disposed at a position where the ferromagnetic material pairs with the electromagnet across a permeability sensor.

3. The developing device as defined in claim 1, wherein a counter electromagnet pairing with the electromagnet to form a magnetic field is disposed at a position where the counter electromagnet pairs with the electromagnet across a permeability sensor.

4. The developing device as defined in claim 1, wherein the transport member has a stirring plate disposed at a position close to a permeability sensor.

5. The developing device as defined in claim 4, wherein the stirring plate is set perpendicular to the axis of rotation of the transport member.

6. The developing device as defined in claim 1, wherein a frequency of the alternating current is 1 Hz or higher and 20 Hz or lower.

7. The developing device as defined in claim 1, comprising:

another transport passage for transporting the two-component developer, that is disposed side by side with the transport passage; and communicative connection paths through which the transport passage and the another transport passage are communicatively connected to each other at both ends of both transport passages in a direction of transport of the two-component developer; and wherein the transport passage and the another transport passage transport the developer in directions reverse to each other.

8. An image forming apparatus comprising the developing device as defined in claim 1.

9. The developing device as defined in claim 2, wherein the transport member has a stirring plate disposed at a position close to a permeability sensor.

10. The developing device as defined in claim 3, wherein the transport member has a stirring plate disposed at a position close to a permeability sensor.

11. The developing device as defined in claim 2, comprising:

another transport passage for transporting the two-component developer, that is disposed side by side with the transport passage; and communicative connection paths through which the transport passage and the another transport passage are communicatively connected to each other at both ends of both transport passages in a direction of transport of the two-component developer; and wherein the transport passage and the another transport passage transport the developer in directions reverse to each other.

12. The developing device as defined in claim 3, comprising:

another transport passage for transporting the two-component developer, that is disposed side by side with the transport passage; and communicative connection paths through which the transport passage and the another transport passage are communicatively connected to each other at both ends of both transport passages in a direction of transport of the two-component developer; and wherein the transport passage and the another transport passage transport the developer in directions reverse to each other.

13. An image forming apparatus comprising the developing device as defined in claim 2.

14. An image forming apparatus comprising the developing device as defined in claim 3.

* * * * *